US005591559A

United States Patent [19]

Odell

[11] Patent Number: 5,591,559

[45] Date of Patent: Jan. 7, 1997

[54] SUPERCRITICAL TONER PROCESSES

[75] Inventor: Peter G. Odell, Mississauga, Canada

[73] Assignee: Xerox Corporation, Stamford, Conn.

[21] Appl. No.: 314,745

[22] Filed: Sep. 29, 1994

[51] Int. Cl.[6] ..... G03G 9/08

[52] U.S. Cl. ..... 430/137; 430/109; 430/111

[58] Field of Search ..... 430/111, 109, 430/137

[56] References Cited

U.S. PATENT DOCUMENTS

| | | | |
|---|---|---|---|
| 3,586,654 | 6/1971 | Lerman et al. | 430/137 |
| 3,669,922 | 6/1972 | Bartsch et al. | 430/137 |
| 3,969,196 | 7/1976 | Zosel | 203/49 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,206,108 | 4/1993 | Felder et al. | 430/137 |

*Primary Examiner*—Janis L. Dote
*Attorney, Agent, or Firm*—E. O. Palazzo

[57] ABSTRACT

A process comprising subjecting a toner comprised of resin and pigment to a particle size reduction in an organic fluid containing from about 2 to about 60 percent of solids, which solids are comprised of resin, pigment, and optional charge additive; accomplishing supercritical extraction thereof; and isolating said toner.

20 Claims, No Drawings

SUPERCRITICAL TONER PROCESSES

BACKGROUND OF THE INVENTION

The present invention is generally directed to toner processes, and more specifically to processes for the preparation of dry toner compositions and liquid developers comprised of a hydrocarbon, thermoplastic resin, pigment, charge adjuvant and charge director, reference U.S. Pat. Nos. 5,306,591 and 5,308,731 the disclosures of which are totally incorporated herein by reference. In embodiments, the present invention is directed to the economical preparation of dry toners by wet milling methods followed by supercritical extraction, reference U.S. Ser. No. 315,005, the disclosure of which is totally incorporated herein by reference. Dry toner compositions obtained with the processes of the present invention possess an average volume diameter of submicron, that is less than 1 micron, or from about 1 to about 25, and preferably from 1 to about 12 microns as measured on the Horiba Capa 7000 centrifugal particle size analyzer. The resulting dry toners can be selected for known electrophotographic imaging, printing processes, including color processes, and lithography.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to about 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to about 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns, and with higher pigment loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 2 microns to about 9, and preferably 5 microns, are attained without resorting to further classification processes, and wherein narrow geometric size distributions are attained, such as from about 1.1 6 to about 1.30, and preferably from about 1.16 to about 1.25. High toner yields are also attained, such as from about 90 percent to about 98 percent, in embodiments of the present invention. In addition, by the toner particle preparation process of the present invention in embodiments, small particle size toners of from about 2 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. Similarly, the aforementioned disadvantages, for example poor GSD, are obtained hence classification is apparently required resulting in low toner yields. In U.S. Pat. No. 4,797,339, there is disclosed a process for the preparation of toners by resin emulsion polymerization, wherein similar to the '127 patent certain polar resins are selected; and in U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process of the present invention has several advantages as indicated herein including in embodiments the effective preparation of small toner particles; yields of toner are high, for example at least 95 percent, and in embodiments from about 96 to about 99 percent; large amounts of power consumption are avoided as mechanical particle size reduction, such as rotor stator mixers, piston homogenizers, microfluidizers, are generally more energy efficient than jet milling, therefore, rendering it attractive and economical; many resins, particularly those based on polyethylene, form small particles when cooled from about 100° C. to room temperature in a hydrocarbon; the process allows particles to be used as dry toner, and it is a controllable process since the particle size of the toner can be determined by further processing, additional milling in a media mill or changing the conditions such as pressure or chamber size in a microfluidizer or piston homogenizer; and there can be selected toner resins that are not sufficiently friable to allow them to be effectively jetted, and wherein toner resins with brittle and/or ductile characteristics can be selected.

Wet milling techniques for toner production have generally been confined to the production of particles for electrostatic liquid development with no provision for obtaining a liquid free material for dry electrostatic development. A variety of processing options are available for dispersions in a liquid. In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media is particularly useful when colorants other than black are used. A typical diameter range for the particulate media is in the range of 0.04 to 0.5 inch (approximately 1.0 to approximately 13 millimeters). Other processes include extrusion, for example U.S. Pat. No. 5,017,451 illustrates extrusion for melt mixing and a microfluidizer for particle size reduction. Also, in U.S. Pat. No. 5,387,489, the disclosure of which is totally incorporated herein by reference, there can be selected a piston homogenizer for particle size reduction.

When using an attritor, sufficient nonpolar liquid is added to provide a dispersion of from about 10 to about 50 percent solids comprised of resin, about 75 to 98 weight percent, colorant or pigment about 2 to 25 percent, optional charge additive from about 1 to about 3 percent, and flow additives like colloidal silicas, metal oxides, metal salts of fatty acids, in amounts of, for example, from about 1 to about 2 percent. This mixture is then subjected to elevated temperatures during the initial mixing procedure to plasticize and soften the resin. The mixture is sufficiently heated to provide a uniform dispersion of the solid materials of, for example, colorant, charge director, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene gylcol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

In U.S. Pat. No. 5,206,108 there is illustrated the use of hexane in combination with filtration or centrifugation to remove the aliphatic hydrocarbon vehicle in which the toner was generated will result in the inevitable contamination of the toner by organic solvents used for extraction. These contaminants possess a significant vapor pressure and are a health hazard that precludes their use in most environments, moreover the process generates a great deal of toxic waste that must be recovered or disposed of.

The copending application U.S. Ser. No. 315,005, the disclosure of which is totally incorporated herein by reference, illustrates a supercritical extraction process directed to toners for liquid electrostatic applications and provides toners of 30 to 50 percent solids in a hydrocarbon.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

In U.S. Pat. No. 5,370,963, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In U.S. Pat. No. 5,403,693, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In U.S. Pat. No. 5,418,108, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii)(b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In U.S. Pat. No. 5,405,728, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of fine dry black and colored toner compositions In another object of the present invention there are provided simple and economical milling processes for dry black and colored toner compositions, and wherein supercritical extraction carbon dioxide can be selected to remove hydrocarbons, or other fluids in which the dry toner is dispersed enabling toners with a size of from about 1 to about 10 microns in embodiments.

In a further object of the present invention there is provided a process for the preparation of dry toner compositions with an average particle volume diameter of from between about 1 to about 20 microns, and preferably from about 1 to about 5 microns in average volume diameter.

In a further object of the present invention there is provided a process for the preparation of toner compositions with certain effective particle sizes without classifications in embodiments by emulsification or by wet milling the toner in a hydrocarbon and with a piston homogenizer to permit small toners of 1 to 10 microns, followed by the carbon dioxide supercritical rapid extraction of the hydrocarbon.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent, and which is obtained in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical direct preparation of dry toner compositions by wet milling methods; followed by carbon dioxide extraction, and more specifically a process comprising subjecting a toner comprised of resin and pigment to a particle size reduction in an organic fluid containing from about 2 to about 60 percent of solids, which solids are comprised of resin, pigment, and optional charge additive; accomplishing supercritical extraction thereof; and isolating said toner.

In embodiments, the present invention is directed to processes for the preparation of dry toner compositions which comprises initially preparing toner in an extrusion device, a Banbury, a continuous mixer, an attritor, and the like; effecting a particle size reduction, for example from about 70 to about 20 microns in embodiments of the resulting toner, with, for example, piston homogenizers, microfluidizers, colloid mills, roll mills and the like, preferably in the presence of a hydrocarbon like aliphatic hydrocarbons such as pentadecane, hexadecane, NORPAR®, ISOPAR®, and the like. Also, fluid mediums like mineral oils, natural oils, fatty acids, and the like can be selected in effective amounts of, for example, from about 50 to about 500 milliliters in embodiments; thereafter, accomplishing supercritical extraction of the hydrocarbon or dispersing liquid; and isolating the toner obtained with a size diameter of from 1 to about 15, or from about 1 to about 5 microns in average volume diameter. In embodiments of the present invention, there are provided processes for the preparation of dry developer compositions wherein the organic fluid thereof is a linear or branched chain aliphatic hydrocarbon containing from 1 to about 25 carbons, a mineral oil, or a fatty acid; a process wherein the organic fluid is a hydrocarbon including, but not limited to, pentadecane, hexadecane, canola oil, coconut oil, corn oil, palm oil, mineral spirits or mixture thereof; a process wherein a supercritical extraction is accomplished with carbon dioxide at temperatures of from between about 20° and about 60° C., the pressure is between about 1,000 and about 6,000 psi, and the organic fluid is separated from the carbon dioxide by reducing the pressure, and wherein the carbon dioxide is reused by recompressing said carbon dioxide; a process wherein the toner obtained is of a volume average diameter of from about 1 to about 7 microns; a process wherein the resin is a copolymer of ethylene and an α, β-ethylenically unsaturated acid; a process wherein the toner contains additives; a process wherein the supercritical extraction is effected in a closed chamber, followed by opening the chamber, and removing the toner in a batch or in a continuous manner; a process wherein the toner particle size reduction is from about 2 to about 3 millimeters to from about 1 to 20 microns; a process wherein the organic fluid of the liquid developer contains toner solids of resin, about 75 to about 98 weight percent of toner solids, pigment, about 2 to about 25 weight percent of toner solids, charge additive, about 1 - to about 3 weight percent of toner solids; the toner solids amount in the organic fluid is from about 2 to about 60 weight percent of the organic fluid and toner solids; and the amount by weight of supercritical extraction carbon dioxide is about 20 times the weight of the organic fluid; and a process wherein about 5 grams of organic fluid comprised of a hydrocarbon per 100 grams of carbon dioxide are selected.

A variety of processes may be employed to compound the toner components and to effect particle size reduction. For example, about (175.0) grams of NUCREL 599® (a copolymer of ethylene and methacrylic acid available from E.I. DuPont de Nemours & Company, Wilmington, Del.), about 45.4 grams of the cyan pigment (PV FAST BLUE™), and about 370.4 grams of NORPAR 15® a normal paraffinic petroleum solvent (Exxon Corporation) can be added to a Union Process attritor (Union Process Company, Akron, Ohio) charged with 0.1857 inch (4.76 millimeters) diameter carbon steel balls. The mixture may be milled in the attritor, which is heated to about 106° C. for about 2 hours, by running steam through the attritor jacket to mix the toner components thoroughly. About 980.1 grams of additional NORPAR® is added, the attritor is cooled by running water through the attritor jacket to ambient temperature, and the mixture was ground in the attritor for an additional 4 hours. Additional NORPAR 15®, about 1,400 to 1,600 grams, was added and the mixture was separated from the steel balls. The solids components are comprised of resin, pigment, and optional toner additives in effective amounts of resin, for example about 75 to about 98 weight percent, and pigment, about 2 to about 25 weight percent. The solids amount can be measured by heating about 20 grams of the suspension of toner of the above composition in NORPAR 15® under heat lamps, and after 24 to 48 hours of heating or until there was no further weight loss due to NORPAR® evaporation. The residual solid constituted about 7.29 percent by weight of the original suspension in embodiments. The solid constituents were 78 percent by weight of NUCREL 599®, and 22 percent by weight of PV FAST BLUE™ pigment. About 75 milliliters of this suspension were added to the extraction vessel filling it completely. The extraction system employed was an Autoclave Engineers, Inc. Model #08U 06 60 FS Supercritical Extraction Screening system. The vessel was closed and slowly pressurized to avoid pushing the suspension out of the vessel. Initial conditions were pressure between 1,900 and 2,100 psi and a temperature of 40° to 45° C. Approximately 10 milliliters of colorless liquid were collected in an hour, during which the carbon dioxide pressure ranged from about 1,600 to about 4,000 psi. About 46 milliliters of colorless NORPAR® were collected. The flow rate of carbon dioxide at standard temperature and pressure varied between 0.05 and 0.06 cfm. The system was depressurized, and an intense blue powder was removed from the extraction vessel. TGA analysis of the original liquid ink indicated that it was comprised of 7.04 percent solids, and the extracted toner by the same technique provided between 98.3 and 98.6 percent solids, depending, for example, on the choice of the analysis parameters, and which solids were comprised of 78 percent by weight of NUCREL 599®, and 22 percent by weight of PV FAST BLUE™ pigment. Particle size analysis with a Horiba Capa 7000 centrifugal particle size analyzer indicated an average particle diameter for the dry toner of 1.8 microns with a standard deviation of 1.35 microns.

Illustrative examples of resin particles, resins or polymers selected for the process of the present invention include known components such as poly(styrene-butadiene), poly- (para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alphamethylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic polyhexylene-terephthalate, polyheptylene-terephthalate, polyoctylene acid), poly(styrene-butadiene-methacrylic acid), PLIOTONE™ available from Goodyear, polyethylene-terephthalate, polypropyleneterephthalate, polybutylene-terephthalate, polypentylene-terephthalate, POLYLITE™ a polyester resin, (Reichhold Chemical Inc), PLASTHALL™ a polyster, (Rohm & Hass), CYGAL™ CYGLAS™, a polyster, (American Cyanamide), ARMCO™, a polyster, (Armco Composites), CELANEX™, a glass reinforced polyester, (Celanese Eng), RYNITE™, a polyster, (DuPont), STYPOL™, a polyester, (Freeman Chemical Corporation) and the like. The resin selected, which generally can be, in embodiments, styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; magnetites TMB-100™, or TMB-104™; and the like. As colored pigments, there can be selected cyan, magenta, yellow, red, green, brown, blue or mixtures thereof. Specific examples of pigments include phthalocyanine, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight, and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

Embodiments of the present invention include a process for the preparation of toner comprising subjecting a toner comprised of resin and pigment to a particle size reduction in an organic fluid containing from about 2 to about 60 percent solids; accomplishing a supercritical carbon dioxide extraction thereof, and isolating said toner; and wherein the supercritical extraction comprises the following: concentrating the organic fluid by centrifugation or filtration prior to extraction, adding said toner suspended in hydrocarbon into a pressure vessel and introducing during extraction carbon dioxide by means of a pump; increasing the pressure of the carbon dioxide with the pump to about 3,000 to about 4,000 psi; optionally heating the vessel to about 30° to 40° C.; continuously removing the carbon dioxide as hydrocarbon dissolves therein while replenishing with hydrocarbon free carbon dioxide; providing a means to maintain back pressure of the carbon dioxide by means of a valve or small orifice; heating said valve or orifice to reduce cooling effects of the expanding carbon dioxide; reducing the pressure of the carbon dioxide as it passes through the valve or orifice; recovering the extracted hydrocarbon in a vessel or filters; and optionally repressurizing the carbon dioxide once the hydrocarbon is removed and repressurizing it for further extraction.

The following Examples are provided.

EXAMPLE I

One hundred and seventy-five (175.0) grams of NUCREL 599® (a copolymer of ethylene and methacrylic acid with a melt index at 190° C. of 500, available from E. I. DuPont de Nemours & Company, Wilmington, Del.), 45.4 grams of the cyan pigment (PV FAST BLUE™), and 370.4 grams of NORPAR 15® (Exxon Corporation) were added to a Union Process attritor (Union Process Company, Akron, Ohio) charged with 0.1857 inch (4.76 millimeters) diameter carbon steel balls. The mixture was milled in the attritor which was heated with running steam through the attritor jacket at 55° C. to 106° C. for 2 hours, and 980.1 grams of additional NORPAR® were added, the attritor was cooled by running water through the attritor jacket to ambient temperature, and the mixture was ground in the attritor for an additional 4 hours. Additional NORPAR 15®, about 1,400 to 1,600 grams, was added, and the mixture of toner suspended in the NORPAR 15® hydrocarbon was separated from the steel balls. The percent solids was measured by heating about 20 grams of the suspension of the toner comprised of NUCREL 599®, 78 percent, and 22 percent by weight of PV FAST BLUE™ pigment in NORPAR 15® under heat lamps, and after 24 to 48 hours of heating, or until there was no further weight loss due to NORPAR® evaporation, the residual solid constituted about 7.29 percent by weight of the original suspension. The solid contained NUCREL 599® and PV FAST BLUE™ pigment. About 75 milliliters of this suspension were added to the extraction vessel, filling it completely. The vessel was closed and slowly pressurized to avoid pushing the toner suspension out of the vessel. Initial conditions were pressure between 1,900 and 2,100 psi and temperature 40° C. to 45° C. In the first 30 minutes, a few drops of clear NORPAR® were collected, followed by two hours of higher pressure but no NORPAR® collected, possibly due to it solidifying in the pressure release needle valve. More heat was applied to the needle valve and NORPAR® began to collect, approximately 10 milliliters of colorless liquid was collected in an hour, during which time the pressure averaged around 1,600 to 1,900 psi and the temperature was 42° C. The system was then shut down for the night, about 18 hours. During repressurization the next day, about 10 milliliters of colored ink bumped over into the separator vessel; after stabilizing, more colorless NORPAR®was collected, about 5 milliliters over the course of 90 minutes, before the extraction system malfunctioned. The extraction system was repaired, and over the course of about 55 minutes of operation between 3,000 and 4,000 psi and 41° C. to 43° C., about 12 to 13 milliliters of NORPAR® were collected before shutting down for the night. The experiment was resumed the next day and under similar conditions, but slightly higher flow rates, 0.06 versus 0.05 cfm $CO_2$ (STP) exiting from the extraction vessel. In the first 35 minutes, 12.8 milliliters were collected; the next 35 minutes produced 6.5 milliliters; and the next 100 minutes produced only the occasional drop. The system was depressurized, and an intense blue powder was removed from the extraction vessel. TGA analysis of the starting toner suspension indicated that it was comprised of 7.04 percent solids of NUCREL 599®, and 22 percent by weight of PV FAST BLUE™ pf pigment, and the extracted dry toner of the same composition by the same technique provided between 98.3 and 98.6 percent solids, depending on choice of analysis parameters. Particle size analysis with a Horiba Capa 7000 centrifugal particle size analyzer provided a dry toner with an area average particle diameter of 1.8 microns with a standard deviation of 1.35 microns.

EXAMPLE II

NUCREL 599® (74 weight percent), Paliotol Yellow D1155 (25 weight percent), and bis(3,5-di-t-butylsalicylato) aluminum hydroxide (1 weight percent) were melt mixed in a ZSK30 extruder and pelletized. 50 Grams of the pelletized product were combined with 450 grams of SUPERLA NF5™ mineral oil (Amoco)in a 1 liter container and processed with a PTA 45/6 Polytron probe at speeds of between 5,000 to 10,000 rpm while being cooled by an ice bath to provide material that would pass through an 80 micron screen. An addition of about 800 milliliters of mineral oil was required for the wet sieving. About 1 liter of the sieved suspension was processed through a model 110Y microfluidizer at 12,000 psi passing through a 200 micron back pressure module followed by a 75 micron interaction chamber. The material was collected after each pass and then added again to the microfluidizer reservoir; thus the material made 5 to 6 passes through the microfluidizer over the course of about 12 minutes. The resulting suspension was centrifuged at 4,000 rpm for 20 minutes in a Baxter Cryrofuge 6000. There was then transferred about 65 grams of the centrifuge cake into an Autoclave Engineering extraction vessel. The extraction vessel was equipped with 2 micron sintered metal screens at both ends to retain the solid product. The extraction vessel was sealed and installed in a modified AE SFE Screening unit, the modification being the use of a pressure regulator followed by a needle valve to control the rate of release of carbon dioxide and hence its pressure in the extraction system. The mineral oil was extracted at temperatures of about 36° C. to 37° C. and pressures ranging from 1,500 to 4,000 psi, but primarily at 3,000 psi. The flow of supercritical $CO_2$ was upward through the vertical vessel. Approximately 82 cubic feet of carbon dioxide at standard temperature and pressure were used, but the major portion of the mineral oil was removed with the first 20 cubic feet. A total of about 50 milliliters of mineral oil was collected during the extraction. About 9 grams of a yellow toner were recovered, and particle size analysis using a Horiba Capa 7,000 gave an average size of 5 microns by area. Thermogravimetric analysis showed a weight loss at 300° C. of 3.3 percent for the sample. A control sample of the original pellets from the extruder prior to any further processing displayed a weight loss at 300° C of 4.7 percent under the same conditions. The difference between the samples can be attributed to instrument error combined with the possible extraction of residual methacrylic acid from the NUCREL® resin. The conclusion is that the mineral oil is essentially completely extracted.

Dry toners can be prepared in a similar manner with the exceptions that only resin, such as styrene methacrylate and carbon black like REGAL 330®, were selected, and the carbon dioxide supercritical extraction of hydrocarbon thereof is accomplished.

EXAMPLE II

DRY TONER

The following materials were dry mixed in a Waring blender: 4.0 grams of peroxide/polyester blend generated by adding dropwise 0.6 gram of t-butyl hydroperoxide to 100 grams of copoly[4,4'-isopropylidenebisphenyl bispropanol bisether/fumaric acid] (SPAR II™). Further, dispersion of the peroxide into the polyester was achieved by dry mixing in a Waring blender. The peroxide/polyester mixture was then extruded at 120° C. and 90 rpm in a Custom Scientific Instruments Extruder. The product resulting was reground in the Waring blender and there resulted 11.6 grams of copoly [4,4'-isopropylidenebisphenyl bispropanol bisether/fumaric acid]; 4.0 grams of copoly[(4,4'-isopropylidenebisphenyl bispropanol bisether, N-phenyl-diethanolamine)/fumaric acid] (0.45:0.05:0.5 molar); and 0.4 gram of PV FAST BLUE™.

This aforementioned product mixture was added to a Custom Scientific Instruments Extruder operated at 150° C. and 90 rpm. Once the intense blue color extrudate appeared, the rotation of the extruder was stopped for one minute to allow the reaction to start, rotation was resumed, and extrudate was collected for the next 20 to 30 minutes. This extrudate was comprised of a cyan toner with the composition above except that gel forming crosslinking had occurred. It is estimated that the crosslinked polyester resin gel content was about 2 to 5 percent based on rheological measurements.

About 16 grams of the extrudate produced above was broken into small pieces with a hammer and then combined with 150 grams of SUPERLA NF™ mineral oil (Amoco) in a 500 milliliter container, and processed with a PTA 45/6 Polytron probe at speeds of between 5,000 to 10,000 rpm while being cooled by an ice bath to provide material that would pass through an 80 micron screen.

The smaller than 80 micron particles were suspended in about 00 milliliters of mineral oil and were processed in Model HTD1 piston homogenizer obtained from the Union Pump Company of North Andover, Mass. The operating pressure was about 5,000 psi and the suspension was recycled through a heat exchanger cooled with water to maintain the temperature of the suspension at about 20° C. The processing time would be about 10 minutes.

The suspension of small toner particles was allowed to settle for about 16 hours and then the clear upper layer decanted off, and about 70 milliliters of the lower layer containing toner particles could be transferred to the extraction vessel of an Autoclave Engineering SFE Screening unit. The extraction vessel was equipped with 2 micron sintered metal screens at both ends to retain the solid product. Subsequently, the extraction vessel was sealed and installed in a modified extraction system, the modification being the use of a pressure regulator followed by a needle valve to control the rate of release of added carbon dioxide and hence its pressure in the extraction system, and the mineral oil was extracted with carbon dioxide at temperatures of about 36° C. to 37° C. and pressures primarily at 3,000 psi. The flow of supercritical $CO_2$ was upward through the vertical vessel. Approximately 25 cubic feet of carbon dioxide at standard temperature and pressure were used to extract the mineral oil. The final product was a dry cyan polyester resin based toner of about 7 micron average volume diameter.

Other modifications of the present invention may occur to those skilled in the art subsequent to a review of the present application, and these modifications, including equivalents thereof, are intended to be included within the scope of the present invention.

What is claimed is:

1. A process consisting essentially of subjecting a toner comprises of toner solids, which comprise of resin, pigment and charge additive to a particle size reduction in a hydrocarbon fluid; accomplishing supercritical carbon dioxide extraction of said hydrocarbon fluid with supercritical carbon dioxide in an amount, by weight, that is about 20 times a weight of said hydrocarbon fluid; and isolating said toner, wherein said size-reduced resin constitutes an amount of about 75 to about 98 weight percent of said toner solids, said pigment constitutes an amount of about 2 to about 25 weight percent of said toner solids, and said charge additive constitutes an amount of about 1 to about 3 weight percent of said toner solids; and an amount of said toner solids in said hydrocarbon fluid is from about 2 to about 60 weight percent of a total weight of said hydrocarbon fluid and said toner solids.

2. A process in accordance with claim 1 wherein the particle size reduction is effected in a microfluidizer, a colloid mill, a roll mill, an attritor, or a piston homogenizer.

3. A process in accordance with claim 1 wherein the hydrocarbon fluid is selected from the group consisting of linear and branched chain aliphatic hydrocarbon containing from 1 to about 25 carbons.

4. A process in accordance with claim 1 wherein the hydrocarbon fluid is selected from the group consisting of pentadecane, hexadecane, mineral oil, canola oil, coconut oil, corn oil, palm oil, and mineral spirits.

5. A process in accordance with claim 1 wherein the particle size reduction is effected by impact between hard media present in an attritor over a period of from about 2 to about 24 hours, or wherein said particle size reduction is accomplished by continuous accelerative or pressure drop devices.

6. A process in accordance with claim 1 wherein the supercritical extraction is accomplished at temperatures of from between about 20° and about 60° C., the pressure is between about 1,000 and about 6,000 psi, and the hydrocarbon fluid is separated from the carbon dioxide by reducing the pressure, and wherein said carbon dioxide is reused by recompressing said carbon dioxide.

7. A process in accordance with claim 6 wherein the resin is selected from the group consisting of poly(styrene-butadiene-acrylic acid) poly(styrene-butadiene-methacrylic acid), poly(styrene-butylmethacrylate-acrylic acid), poly(styrene-butylacrylate-acrylic acid), polyethylene-terephthalate, polypropylene-terephthalate, polybutylene-terephthalate, polypentylene-terephthalate, polyhexylene-terephthalate, polyheptylene-terephthalate, polystyrene-butadiene, and polyoctylene-terephthalate.

8. A process in accordance with claim 1 wherein said size-reduced toner is of a volume average diameter of from about 1 to about 7 microns.

9. A process in accordance with claim 1 wherein the resin is a styrene methacrylate, a styrene acrylate, a styrene butadiene, or a polyester.

10. A process in accordance with claim 1 wherein the resin is copolymer of ethylene and an α,β-ethylenically unsaturated acid.

11. A process in accordance with claim 1 wherein the pigment is black in color.

12. A process in accordance with claim 1 wherein the pigment is cyan, magenta, yellow, blue, green, red, or brown pigment, or mixtures thereof.

13. A process in accordance with claim 1 wherein the toner contains additives.

14. A process in accordance with claim 1 wherein the supercritical extraction is accomplished at a temperature of from between about 30° C. and about 40° C., and at a pressure of between about 3,000 and about 4,000 psi.

15. A process in accordance with claim 1 wherein the toner particle size reduction is from about 2 to about 3 millimeters to from about 1 to 20 microns.

16. A process in accordance with claim 1 wherein the amount of hydrocarbon fluids is about 5 grams per 100 grams of carbon dioxide.

17. A process for the preparation of toner comprising subjecting a toner comprising toner solids comprised of resin, pigment and charge additive to a particle size reduction in a hydrocarbon fluid, accomplishing a supercritical carbon dioxide extraction of said hydrocarbon fluid with supercritical carbon dioxide in an amount, by weight, that is about 20 times a weight of said hydrocarbon fluid, and isolating said size-reduced toner, wherein said resin constitutes an amount of about 75 to about 98 weight percent of said toner solids, said pigment constitutes an amount of about 2 to about 25 weight percent of said toner solids, and said charge additive constitutes an amount of about 1 to about 3 weight percent of said toner solids; and an amount of said toner solids in said hydrocarbon fluid is from about 2 to about 60 weight percent of a total weight of said hydrocarbon fluid and said toner solids.

18. A process in accordance with claim 17 wherein the supercritical extraction is effected in a closed chamber, followed by opening the chamber, and removing the sozed-reduced toner in a batch or in a continuous manner.

19. A process consisting essentially of subjecting a toner comprising toner solids which contain resin, pigment and charge additive to a particle reduction in a hydrocarbon fluid, subsequently accomplishing a supercritical carbon dioxide extraction of said hydrocarbon fluid with supercritical carbon dioxide in an amount, by weight, that is about 20 times a weight of said hydrocarbon fluid, and isolating said size-reduced toner, wherein said size-reduced toner suspended in hydrocarbon fluid is added to a pressure vessel, said carbon dioxide is provided by a pump at a pressure of from about 3,00 to 4,000 psi, and the extraction is carried out by heating the pressure vessel to about 300° to 40° C., continuously removing the carbon dioxide as the hydrocarbon fluid dissolves therein while replenishing with hydrocarbon fluid free carbon dioxide; maintaining back pressure of the carbon dioxide by means of a valve or small orifice; heating said valve or orifice to reduce cooling effects of the expanding carbon dioxide; reducing the pressure of the carbon dioxide as it passes through the valve or orifice; recovering the extracted hydrocarbon fluid in a vessel or filters; and optionally repressurizing the carbon dioxide once the hydrocarbon fluid is removed for further extraction; and wherein said resin constitutes an amount of about 75 to about 98 weight percent of said toner solids, said pigment constitutes an amount of about 2 to about 25 weight percent of said toner solids, and said charge additive constitutes an amount of about 1 to about 3 weight percent of said toner solids; and an amount of said toner solids in said hydrocarbon fluid is from about 2 to about 60 weight percent of the total weight of said hydrocarbon fluid and said toner solids.

20. A process consisting of subjecting a toner comprising toner solids comprised of resin, pigment and charge additive to a particle size reduction in a hydrocarbon fluid; accomplishing supercritical carbon dioxide extraction of said hydrocarbon fluid with supercritical carbon dioxide in an amount, by weight, that is about 20 times a weight of said hydrocarbon fluid; and isolating said toner, wherein said size-reduced resin constitutes an amount of about 75 to about 98 weight percent of said toner solids, said pigment constitutes an amount of about 2 to about 25 weight percent of said toner solids, and said charge additive constitutes an amount of about 1 to about 3 weight percent of said toner solids; and an amount of said toner solids in said hydrocarbon fluid is from about 2 to about 60 weight percent of the total weight of said hydrocarbon fluid and said toner solids.

* * * * *